US009508462B2

(12) United States Patent
Tsuru

(10) Patent No.: US 9,508,462 B2
(45) Date of Patent: Nov. 29, 2016

(54) SN-COATED COPPER ALLOY STRIP HAVING EXCELLENT HEAT RESISTANCE

(71) Applicant: Kabushiki Kaisha Kobe Seiko Sho (Kobe Steel, Ltd.), Kobe-shi (JP)

(72) Inventor: Masahiro Tsuru, Shimonoseki (JP)

(73) Assignee: Kobe Steel, Ltd., Kobe-shi (JP)

( * ) Notice: Subject to any disclaimer, the term of this patent is extended or adjusted under 35 U.S.C. 154(b) by 12 days.

(21) Appl. No.: 14/012,416

(22) Filed: Aug. 28, 2013

(65) Prior Publication Data

US 2014/0065440 A1 Mar. 6, 2014

(30) Foreign Application Priority Data

Aug. 29, 2012 (JP) ..... 2012-189314

(51) Int. Cl.

| | |
|---|---|
| ***H01B 1/02*** | (2006.01) |
| ***C25D 5/12*** | (2006.01) |
| ***C25D 5/50*** | (2006.01) |
| ***C23C 28/02*** | (2006.01) |

(52) U.S. Cl.

CPC ..... *H01B 1/026* (2013.01); *C23C 28/021* (2013.01); *C25D 5/12* (2013.01); *C25D 5/505* (2013.01); *Y10T 428/12715* (2015.01)

(58) Field of Classification Search

None

See application file for complete search history.

(56) References Cited

U.S. PATENT DOCUMENTS

| | | | |
|---|---|---|---|
| 2003/0129441 | A1 | 7/2003 | Hara et al. |
| 2004/0209112 | A1 | 10/2004 | Hara et al. |
| 2008/0090096 | A1 | 4/2008 | Suzuki et al. |
| 2009/0061253 | A1 | 3/2009 | Yoshida et al. |
| 2010/0247959 | A1* | 9/2010 | Taira ..... C25D 5/12 428/675 |
| 2010/0304016 | A1 | 12/2010 | Suzuki et al. |
| 2011/0266035 | A1 | 11/2011 | Sakurai et al. |
| 2013/0237105 | A1 | 9/2013 | Tsuru et al. |
| 2013/0260174 | A1 | 10/2013 | Tsuru |
| 2014/0134457 | A1 | 5/2014 | Sakurai et al. |

FOREIGN PATENT DOCUMENTS

| | | | |
|---|---|---|---|
| CN | 1985333 | A | 6/2007 |
| CN | 101845647 | A | 9/2010 |
| CN | 102239280 | A | 11/2011 |
| EP | 1 281 789 | A1 | 2/2003 |
| EP | 1 995 356 | A1 | 11/2008 |
| EP | 2 351 875 | A1 | 8/2011 |
| EP | 2 644 750 | A1 | 10/2013 |
| JP | 2004-68026 | | 3/2004 |
| JP | 2004-300524 | A | 10/2004 |
| JP | 2006-77307 | | 3/2006 |
| JP | 2006-183068 | | 7/2006 |
| JP | 2007-247060 | | 9/2007 |
| JP | 2010-168598 | | 8/2010 |
| JP | 2010-196084 | | 9/2010 |
| KR | 10-2011-0110764 | A | 10/2011 |

OTHER PUBLICATIONS

The Extended European Search Report issued Oct. 8, 2014, in Application No. / Patent No. 13003829.2-1359 / 2703524.

* cited by examiner

*Primary Examiner* — Adam Krupicka

(74) *Attorney, Agent, or Firm* — Oblon, McClelland, Maier & Neustadt, L.L.P.

(57) ABSTRACT

A Sn-coated copper alloy strip including a surface coating layer containing a Ni layer, a Cu—Sn intermetallic compound layer, and a Sn layer formed in this order over the surface of a base material containing a copper alloy strip, in which an average thickness of the Ni layer is from 0.1 to 3.0 μm, an average thickness of the Cu—Sn intermetallic compound layer is from 0.02 to 3.0 μm, an average thickness of the Sn layer is from 0.01 to 5.0 μm, and the Cu—Sn intermetallic compound layer contains only an η-phase or the η-phase and an ϵ-phase.

13 Claims, 1 Drawing Sheet

SN-COATED COPPER ALLOY STRIP HAVING EXCELLENT HEAT RESISTANCE

BACKGROUND OF THE INVENTION

1. Field of the Invention

The present invention relates to a Sn-coated copper alloy strip used as a conductive material for connecting parts such as a terminal in the field of automobiles and other consumer products, which can maintain low contact resistance at a terminal contact portion for long time.

2. Description of the Related Art

In automobiles electric equipment, mating connectors comprised of male and female terminal are used for connecting wire harnesses. Recently, electronic equipment is also installed in engine room of automobiles, and connectors are required to keep good electrical property (low contact resistance) for long time at high temperature.

Long time exposure at high temperature of a Sn-coated copper alloy strip increases contact resistance of the strip, because Cu and alloying elements in copper alloy strip diffuse to the surface of the tin coating layer and are oxidized. As a countermeasure, copper alloy strip with three coating layers-base layer of Ni, etc., intermediate layer of Cu—Sn intermetallic compound, and outermost layer of Sn— is suggested in JP-A No. 2004-68026. By this structure, the Ni plating layer prevents diffusion of Cu or other alloy elements from the copper alloy matrix, the Cu—Sn intermetallic compound layer suppresses diffusion of Ni from Ni plating layer, and retains low contact resistance long at high temperature. JP-A No. 2006-183068 describes a Sn-coated copper alloy strip in which surface of the copper alloy strip is roughened, and three layered structure above mentioned is applied as a coating layer on it. Further, JP-A No. 2010-168598 describes a Sn-coated copper alloy strip with three layered structure above mentioned but in which Cu—Sn intermetallic compound layer is of two layers, a lower $\epsilon(Cu_3Sn)$ layer next to the Ni coating layer with the coverage area rate over the Ni layer is 60% or more, and upper $\eta$ $(Cu_6Sn_5)$ layer beneath the Sn plating layer. With this structure, contact resistance after long period at high temperature is stabilized, and exfoliation of the plating layers is prevented.

SUMMARY OF THE INVENTION

Although Sn-coated copper alloy strips described in JP-A No. 2004-68026 and JP-A No. 2006-183068 maintain excellent electrical property (low contact resistance) at 160° C. for 120 hours, as installation of electric components in high temperature engine room of automobiles is rapidly proceeding, further improvement of the Sn-coated copper alloy strip is needed to suppress increase of contact resistance for a longer time.

Further, while the Sn-coated copper alloy strips described in JP-A No. 2010-168598 shows excellent resistance to exfoliation of plating layers for long time at high temperature, same improvement same as above mentioned is demanded. JP-A No. 2010-168598 discloses an example of controlling the thickness of the $Cu_3Sn$ phase, the coverage and the unevenness of the Cu—Sn intermediate compound layer by applying Cu-plating to 0.3 μm thickness and Sn plating to 1.5 μm thickness and applying a reflow treatment under predetermined conditions. However, for obtaining a predetermined reflow texture, it is required to precisely control the plating conditions, reflow treatment conditions (heating rate, heating temperature, cooling rate), etc. and it is not easy for production while exactly following all of such conditions in actual operation.

Accordingly, the present invention mainly intends to provide a Sn-coated copper alloy strip including a surface coating layer of the three layer structure described above and having a more excellent contact reliability (low contact resistance) and further intends to provide a Sn-coated copper alloy strip having more excellent resistance to heat separation.

A Sn-coated copper alloy strip according to the invention includes, a surface coating layer comprising a Ni layer, a Cu—Sn intermetallic compound layer, and a Sn layer formed in this order on a surface of a base material comprising a copper alloy strip, in which an average thickness of the Ni layer is 0.1 to 3.0 μm, an average thickness of the Cu—Sn intermetallic compound layer is from 0.2 to 3.0 μm, the average thickness of the Sn layer is 0.01 to 5.0 μm, the Cu—Sn intermetallic compound layer comprises only an $\eta$-phase $(Cu_6Sn_5)$ or an $\epsilon$-phase $(Cu_3Sn)$ and the $\eta$-phase, the $\epsilon$-phase is present between the Ni layer and the $\eta$-phase (in a case where the Cu—Sn intermetallic compound layer comprises the $\epsilon$-phase and the $\eta$-phase), and a ratio of an average thickness of the $\epsilon$-phase to an average thickness of the Cu—Sn intermetallic compound layer is 30% or less (inclusive of 0%). Each of the Ni layer and the Sn layer includes a Ni alloy and a Sn alloy, respectively, in addition to Ni metal and Sn metal.

The Sn-coated copper alloy strip of the invention provides the following preferred embodiments.

(1) In the cross section of the surface coating layer, a ratio of a length of the $\epsilon$-phase to a length of the n-layer is 50% or less.

(2) A portion of the $\eta$-phase is exposed to the surface of the surface coating layer and a ratio of a surface exposure area is 3 to 75%. When the $\eta$ phase is exposed, the surface roughness is 0.03 μm or more and less than 0.15 μm in the direction perpendicular to rolling direction, or an arithmetic mean roughness Ra at least in one direction is 0.15 μm or more and an arithmetic mean roughness Ra in all of the directions is 3.0 μm or less (refer to JP-A No. 2006-183068).

(3) A Co layer or a Fe layer is formed instead of the Ni layer as a base coating layer and an average thickness of the Co layer or the Fe layer is 0.1 to 3.0 μm.

(4) When the Ni layer is present, a Co layer or a Fe layer is formed between the surface of the base material and the Ni layer or between the Ni layer and the Cu—Sn intermetallic compound layer, and an average thickness of the Ni layer and the Co layer in total or the Ni layer and the Fe layer in total is 0.1 to 3.0 μm.

(5) In the surface of the material after heating at 160° C. for 1,000 hours in the air, $Cu_2O$ is not present at a depth of 15 nm from the surface.

According to the present invention, since the Sn-coated copper alloy strip capable of maintaining a contact reliability (low contact resistance) which is excellent over the existent material also heating for long time at high temperature can be obtained, electric reliability can be maintained also in a case of using the strip to a multi-pole connector, for example, in automobiles and locating the same in a high temperature atmosphere such as in an engine room.

Further, excellent resistance to heat separation can be obtained also for long time at high temperature by defining the ratio of the length of the $\epsilon$-phase to the length of the Ni layer to 50% or less in the cross section of the surface coating layer.

Further, the Sn-coated copper alloy strip in which a portion of the $\eta$-phase is exposed to the surface can suppress the friction coefficient to a low level and is suitable particularly as a material for a mating terminal.

DETAILED DESCRIPTION OF THE PREFERRED EMBODIMENTS

Figure 1A:
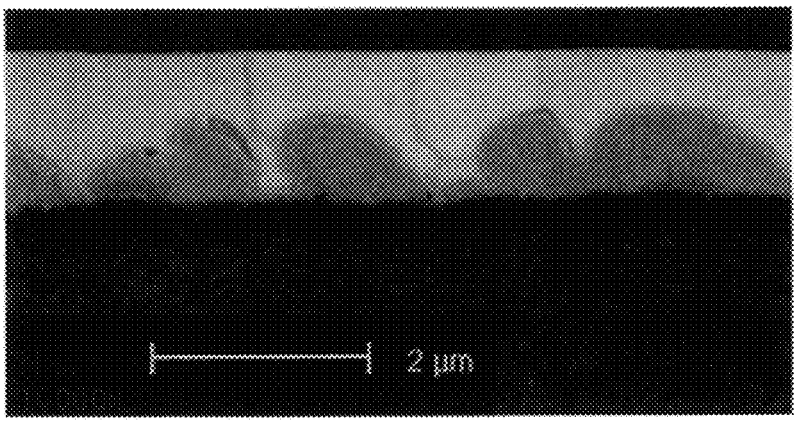
FIG. 1A illustrates cross sectional composition images of a specimen No. 1 of the example in the observation under a scanning electron microscope.

A configuration of a Sn-coated copper alloy strip according to the invention is to be described specifically.

(1) Average Thickness of Ni Layer

A Ni layer suppresses diffusion of constituent elements of a base material to the surface of the material, to suppress growing of a Cu—Sn intermetallic compound layer and prevent consumption of the Sn layer thereby suppressing increase in the contact resistance after long time use at high temperature. However, if an average thickness of the Ni layer is less than 0.1 μm, the intended effect described above cannot be obtained sufficiently, for example, due to increase of pit defects in the Ni layer. On the other hand, if the average thickness of the Ni layer is increased to more than 3.0 μm, the intended effect is saturated and the formability to a terminal is deteriorated, for example, due to occurrence of a crack during bending thereby worsening productivity and economicity. Accordingly, the average thickness of the Ni layer is defined as 0.1 to 3.0 μm an and, more preferably, 0.2 to 2.0 μm.

A small amount of constituent elements, etc. contained in the base material may be incorporated in the Ni layer. When the Ni coating layer comprises a Ni alloy, other constituent elements than Ni of the Ni alloy includes Cu, P, and Co. It is preferred that the Cu is 40 mass % or less and each of P and Co is 10 mass % or less.

(2) Average Thickness of Cu—Sn Intermetallic Compound Layer

A Cu—Sn intermetallic compound layer prevents diffusion of Ni to the Sn layer. If an average thickness of the Cu—Sn intermetallic compound layer is less than 0.2 μm, the effect of preventing diffusion is insufficient in which Ni diffuses to the Cu—Sn intermetallic compound layer or the surface layer of the Sn layer to form an oxide. Since the oxide of Ni has a volumic resistivity greater by 1,000 times or more than that of the oxide of Sn and the oxide of Cu, this increases contact resistance and deteriorates electric reliability. On the other hand, if the average thickness of the Cu—Sn intermetallic compound layer exceeds 3.0 μm, formability to the terminal deteriorates, for example, cracking occurs during bending. Accordingly, the average thickness of the Cu—Sn intermetallic compound layer is 0.1 to 3.0 μm.

(3) Phase Configuration of Cu—Sn Intermetallic Compound Layer

The Cu—Sn intermetallic compound layer comprises only an η-phase ($Cu_6Sn_5$) or an ϵ-phase ($Cu_3Sn$) and the η-phase. The ϵ-phase is formed between the Ni layer and the η-phase (when the Cu—Sn intermetallic compound layer comprises the ϵ-phase and the η-phase) and is in contact with the Ni layer. In the Sn-coated copper alloy strip of excellent heat resistance according to the invention, the Cu—Sn intermetallic compound layer is a layer formed by reaction of Cu plating and Sn plating by a reflow treatment, which comprises only the η phase in an equilibrium state by defining (average Sn plating layer thickness/average Cu plating layer thickness) as greater than 2 and, actually, a non-equilibrium ϵ phase may be formed sometimes. Since the ϵ-phase is harder than the η-phase, presence of the ϵ-phase hardens the coating layer and contributes to decrease in the friction coefficient. However, since the ϵ-phase is brittle compared with the η-phase, when an average thickness of the ϵ-phase is large, formability to the terminal deteriorates, for example, cracking occurs during bending. Further, the ϵ-phase as a non-equilibrium phase transforms into the η-phase as an equilibrium phase at a temperature of 150° C. or higher, Cu of the ϵ-phase thermally diffuses to the η-phase and the Sn layer and, if Cu reaches the surface of the Sn layer, the amount of the Cu oxide ($Cu_2O$) at the surface of the material increases, tending to increase the contact resistance and making it difficult to maintain the reliability of electric connection. Further, by thermal Cu diffusion of the ϵ-phase, voids are formed in the boundary between the Cu—Sn intermetallic compound layer and the Ni layer at portions where the ϵ-phase was present, tending to cause separation at the boundary between the Cu—Sn intermetallic compound layer and the Ni layer. With the reasons described above, the ratio of the average thickness of the ϵ-phase to the average thickness of the Cu—Sn intermetallic compound layer is 30% or less (inclusive of 0%). The ratio of the average thickness of the ϵ phase is preferably 20% or less and more preferably 15% or less.

For suppressing the separation at the boundary between the Cu—Sn intermetallic compound layer and the Ni layer more effectively, it is further preferred to define a ratio of a length of the ϵ-phase to a length of the Ni layer to 50% or less in a cross section of the surface coating layer. This is because voids are generated at the portions where the ϵ-phase was present. A ratio of a length of the ϵ phase to a length of the Ni layer is preferably 40% or less and more preferably 30% or less.

(4) Average Thickness of Sn Layer

If an average thickness of a Sn layer is less than 0.01 μm, since the amount of Cu oxide at the surface of the material increases due to thermal diffusion, for example, by high temperature oxidation, tending to increase the contact resistance and deteriorate the corrosion resistance, it is difficult to maintain the reliability of electric connection. On the other hand, if the average thickness of the Sn layer exceeds 5.0 μm, this is economically disadvantageous and the productivity is also worsened. Accordingly, the average thickness of the Sn layer is 0.01 to 5.0 μm and, more preferably, 0.5 to 3.0 μm.

In a case where the Sn layer comprises a Sn alloy, other constituent elements than Sn in the Sn alloy include Pb, Bi, Zn, Ag, Cu, etc. It is preferred that Pb is less than 50 mass % and other element is less than 10 mass %.

(5) Ratio of Surface Exposure Area of η-Phase: 3 to 75%

When reduction of friction is required upon attachment and detachment of a male terminal and a female terminal, the Cu—Sn intermetallic compound layer is preferably exposed partially to the surface. Since the Cu—Sn intermetallic compound layer is much more harder than Sn or Sn alloy forming the Sn layer, when the Cu—Sn intermetallic compound layer is exposed partially to the surface, deformation resistance due to digging up of the Sn layer upon attachment and detachment of the terminal and shearing resistance that shears Sn—Sn adhesion can be suppressed to remarkably lower the friction coefficient. The Cu—Sn intermetallic compound layer exposed at the surface of the surface coating layer is in an η-phase. If the ratio of the exposure area is less than 3%, the friction coefficient is not decreased sufficiently, and no sufficient effect of decreasing the terminal attachment force can be obtained. On the other hand, if the ratio of surface exposure area of the η-phase is more than 75%, the amount of a Cu oxide on the surface of the surface coating layer increases due to aging or corrosion tending to increase the contact resistance and making it difficult to maintain the reliability of electric connection. Accordingly, the ratio of surface exposure area of the η-phase is 3 to 75%. More preferably, it is 10 to 50%.

There may be various exposure forms of the Cu—Sn intermetallic compound layer (η-phase) that is exposed at the outermost surface of the surface coating layer. JP-A No. 2006-183068 discloses a random texture in which the exposed η-phase is distributed irregularly and a linear texture in which the η-phase extends in parallel. Further, Japanese Patent Application No. 2012-50341 filed by the present applicant describes a linear texture in which the copper alloy of the base material is limited to a Cu—Ni—Si series alloy and extends in parallel to the rolling direction (the ratio of surface exposure area of the η-phase is 10 to 50%) in the specification and the drawing attached thereto. Japanese Patent Application No. 2012-78748 filed by the present applicant describes a composite form comprising a random texture where the exposed η-phase distributes irregularly and a linear texture where the exposed η-phase extends in parallel to the rolling direction (the ratio of the surface exposure area of the η-phase is 3 to 75% in total) in the specification and the drawing attached thereto.

In a case where the exposed η-phase form is in the random texture, the friction coefficient is lowered irrespective of the attaching and detaching direction of the terminal. On the other hand, in a case where the exposed η-phase form is in the linear texture or in the composite form comprising the random texture and the linear texture, the friction coefficient is lowest when attaching and detaching direction of the terminal is in perpendicular to the linear texture. Accordingly, when attaching and detaching direction of the terminal is set in perpendicular to the rolling direction, it is preferred that the linear texture is formed in parallel to the rolling direction.

The Sn-coated copper alloy strip in which the η layer is exposed to the surface of the invention can include two configurations, that is, a form in which the surface of the Sn-coated layer is flat and a form in which it has unevenness.

(5-1) Sn-Coated Layer with Flat Surface: Mean Roughness Ra at the Surface of the Sn-Coated Layer in the Direction Perpendicular to the Rolling Direction of the Base Material is 0.03 μm or More and Less than 0.15 μm.

The mean surface roughness Ra of a usual copper alloy for terminals and connectors is about 0.02 to 0.08 μm and it has been found that the η layer can be exposed to the surface also in such a flat copper alloy strip with no roughening treatment by applying each of Ni, Cu, and Sn platings in this order and then applying a reflow treatment. The surface exposure state of the η phase in this case includes a form where the η layer is exposed linearly parallel to the rolling direction, and a form where the η layer is exposed dot-wise or in an island shape (irregular form) also to the periphery of the η phase exposed linearly parallel to the rolling direction. Since the Cu—Sn intermetallic layer grows in a dome-shape substantially parallel to the surface of the base material, the surface of the Sn-coated layer after the reflow treatment is flat reflecting the surface form of the base material. Since the η phase exposed to the surface does not protrude from the Sn layer in the terminal fabricated from the material of the invention, the area where the mating terminal is in contact with the Sn layer of the material of the invention is increased and the effect of reducing the friction coefficient is somewhat smaller than that of the configuration in claim 6 of the invention. However, since a roughening treatment before plating of the copper alloy strip is not necessary in this embodiment, the production cost can be suppressed. Further, since the η phase extending linearly in the direction parallel to the rolling direction is exposed, insertion force of the terminal can be decreased when the terminal is fabricated so as to be inserted and withdrawn in the direction perpendicular to the rolling direction. The Sn-coated copper alloy strip in this configuration can be produced by combining, for example, formation of rolling marks or polishing marks at a depth equal to or more than that of the usual material to the surface of the copper alloy strip of the base material, reduction of the thickness of Ni plating, and reduction of the thickness of Sn plating as to be described later. In this case, the rolling marks or polishing marks formed in the base material may be defined to have a mean roughness in the direction perpendicular to the rolling direction is 0.03 μm or more and less than 0.15 μm. If deeper rolling marks or polishing marks are formed, they cause problems, for example, that bendability of the base material is deteriorated, or Ni plating tends to be deposited abnormally due to an affected layer formed by polishing on the surface of the base material, so that the mean roughness in the direction perpendicular to the rolling direction of the base material should be 0.03 μm or more and less than 0.15 μm. In the Sn-coated layer prepared from such a base material, the mean roughness Ra in this direction is about 0.03 to 0.15 μm.

(5-2) Sn-Coated Layer with Uneven Surface: An Arithmetic Mean Roughness Ra at Least in One Direction is 0.15 μm or More and an Arithmetic Mean Roughness Ra in all of the Directions is 3.0 μm or Less As described in JP-A No. 2006-183068, a η layer can be exposed to the surface by applying a roughening treatment to the copper alloy strip, applying Ni plating, Cu plating, and Sn plating in this order, and then applying a reflow treatment. The surface exposure form of the phase can include a random form where the exposed phase is distributed irregularly, and a composite form comprising the random form described above and a linear texture extending parallel to be rolling direction. Further, since the copper alloy strip has unevenness and the Sn layer is smoothed by the reflow treatment, the Cu—Sn intermetallic compound metallic layer formed by the reflow treatment protrudes from the Sn layer.

The reason of defining the arithmetic mean roughness Ra in at least in direction of the material surface as 0.15 μm or more and the arithmetic mean roughness Ra in all of the directions as 3.0 μm or less is to be described. When the arithmetic mean roughness Ra in all of the directions is less than 0.15 μm, the protrusion height at the material surface in the Cu—Sn intermetallic compound coating layer is low as a whole, the ratio of the contact pressure received by the hard η phase upon sliding movement and fine sliding movement at the electric contact is reduced and, particularly, reduction of the wear amount of the Sn-coated layer due to fine sliding movement becomes difficult. On the other hand, when the arithmetic mean roughness Ra exceeds 3.0 μm in any of the directions, since the amount of oxides of Cu at the material surface due to thermal diffusion, for example, by high temperature oxidation is increased, tending to increase the contact resistance and the corrosion resistance is also worsened, it is difficult to maintain the reliability of electric connection. Accordingly, the surface roughness of the base material is defined such that the arithmetic mean roughness Ra in at least one direction is 0.15 μm or more and the arithmetic mean roughness Ra in all of the directions is 3.0 μm or less. More preferably, it is 0.2 to 2.0 μm.

Further, the average surface exposure distance of the η phase in at least in one direction at the material surface is preferably 0.01 to 0.5 mm. The average surface exposure distance of the η phase is defined as a sum for an average width of the Cu—Sn intermetallic compound coating layer crossing a straight line drawn on the material surface (length along the straight line) and an average width of the Sn coated layer.

When the average exposure distance at the material surface of the η phase is less than 0.01 mm, the amount of oxides of Cu at the material surface due to thermal expansion, for example, by high temperature oxidation is increased, tending to increase the contact resistance making it difficult to maintain the reliability of the electric connection. On the other hand, when the exposure distance exceeds 0.5 mm, this results in a difficulty of obtaining a low friction coefficient particularly in the use for a small-sized terminal. Generally, since the contact area of electric contact such as indent or rib (insertion and drawing portion) is decreased as the width of the terminal is smaller, provability of contact only between the Sn coated layers increases upon insertion and withdrawal. Since this increases the adhesion amount, it is difficult to obtain a low friction coefficient. Accordingly, it is preferred that the average exposure distance at the material surface of the η phase is 0.01 to 0.5 mm at least in one direction. More preferably, the average exposure distance at the material surface of the η phase is 0.01 to 0.5 mm in all of the directions. This lowers the provability of contact only between the Sn coated layers to each other upon insertion and withdrawal. It is more preferably from 0.05 to 0.3 mm.

(6) Average Thickness of Co Layer and Fe Layer

The Co layer and the Fe layer serve to suppress diffusion of constituent elements of the base material to the surface of the material thereby suppressing growing of the Cu—Sn intermetallic compound layer and preventing consumption of the Sn layer to suppress increase in the contact resistance after long time use at high temperature and obtaining good solder wettability in the same manner as the Ni layer, so that the Co layer or the Fe layer can be used instead of the Ni layer as the base plating layer. However, if the average thickness of the Co layer or the Fe layer is less than 0.1 μm, the intended effect cannot be obtained sufficiently, for example, due to increase of pit defects in the Co layer or the Fe layer in the same manner as in the Ni layer. Further, if the average thickness of the Co layer or the Fe layer is more than 3.0 μm, the intended effect is saturated and the formability to the terminal is deteriorated, for example, by a cracking that occurs during bending to worsen productivity and economicity in the same manner as the Ni layer. Accordingly, when the Co layer or the Fe layer is used instead of the Ni layer as the underlying layer, the average thickness of the Co layer or the Fe layer is 0.1 to 3.0 μm and, more preferably, 0.2 to 2.0 μm.

Further, the Co layer or the Fe layer can also be used as the base plating layer together with the Ni layer. In this case, the Co layer or the Fe layer is formed between the surface of the base material and the Ni layer, or between the Ni layer and the Cu—Sn intermetallic compound layer. The average thickness of the Ni layer and the Co layer in total or the Ni layer and the Fe layer in total is 0.1 to 3.0 μm, more preferably, 0.2 to 2.0 μm by the same reason as in the case of using only the Ni layer, only the Co layer, or only the Fe layer as the base plating layer.

(7) Thickness of $Cu_2O$ Oxide Film

After heating at 160° C. for 1,000 hours in the air, a $Cu_2O$ oxide film is formed due to Cu diffusion on the material surface of the surface coated layer. $Cu_2O$ has an extremely higher electric resistance value than that of $SnO_2$ or CuO, and the $Cu_2O$ oxide film formed on the material surface results in electric resistance. When the $Cu_2O$ oxide film is thin, free electrons pass through the $Cu_2O$ oxide film relatively easily (tunneling effect) and the contact resistance does not increase so much. However, if the thickness of the $Cu_2O$ oxide film is more than 15 nm ($Cu_2O$ is present at a depth of 15 nm or more from the uppermost surface of the material), contact resistance increases. As the ratio of the ϵ-phase in the Cu—Sn intermetallic compound layer is higher, a $Cu_2O$ oxide film of a larger thickness is formed ($Cu_2O$ is formed at a deeper position from the uppermost surface). For keeping the thickness of the $Cu_2O$ oxide film to 15 nm or less thereby preventing increase in the contact resistance, the ratio of the average thickness of the ϵ-phase to the average thickness of the Cu—Sn intermetallic compound layer should be 30% or less.

(8) Preparation Method

The Sn-coated copper alloy strip according to claim 1 of the invention can be prepared, as described in JP-A No. 2004-68026, by forming a Ni plating layer as a base plating to the surface of a copper alloy strip, then forming a Cu plating layer and a Sn plating layer in this order, applying a reflow treatment, forming a Cu—Sn intermetallic compound layer by inter-diffusion of Cu in the Cu plating layer and Sn in the Sn plating layer, and eliminating the Cu plating layer and optionally remaining the molten and solidified Sn plating layer in the surface layer portion. Plating solutions described in JP-A 2004-68026 can be used for each of Ni plating, Cu plating, and Sn plating, and the plating conditions may be set at a current density of 3 to 10 A/dm$^2$ and a bath temperature of 40 to 55° C. for Ni plating, a current density of 3 to 10 A/dm$^2$ and a bath temperature of 25 to 40° C. for Cu plating, and a current density of 2 to 8 A/dm$^2$ and a bath temperature of 20 to 35° C. for Sn plating. A somewhat low current density is preferred. When the Ni plating layer, the Cu plating layer, and the Sn plating layer are referred to in the invention, they mean the surface coating layers before the reflow treatment. When the Ni layer, the Cu—Sn intermetallic compound layer, the Sn layer, and the Sn-coated layer are referred to in the invention, they mean the plating layer after the reflow treatment, or the compound layer formed by the reflow treatment.

The thickness of the Cu plating layer and that of the Sn plating layer are determined while assuming that the Cu—Sn intermetallic compound layer formed after the reflow treatment consists of a single η-phase in the equilibrium state. However, depending on the condition of the reflow treatment, the Cu—Sn intermetallic compound layer cannot sometimes reach the equilibrium state, causing the ϵ-phase to remain. For decreasing the ratio of the ϵ-phase in the Cu—Sn intermetallic compound layer, the conditions may be set so as to approach the equilibrium state by controlling the heating temperature or/and heating time. That is, it is effective to set the reflow treatment time longer and/or the reflow treatment temperature higher. For setting the ratio of the average thickness of the ϵ-phase to the average thickness of the Cu—Sn intermetallic compound layer to 30% or less, a reflow treatment oven having a large heat capacity sufficient to the heat capacity of the coated copper alloy strip to be heat treated are used, the conditions for the reflow treatment are selected within a range between 20 to 40 seconds at an atmospheric temperature of the melting point of the Sn plating layer or higher and 300° C. or lower, and between 10 to 20 seconds at an atmospheric temperature higher than 300° C. and 600° C. or lower. By selecting the conditions such that the time is longer and the temperature is higher within the range described above, the ratio of the length of the ϵ-phase to the length of the Ni layer at the cross section of the surface coating layer can be 50% or less. Further, the crystal grain size of the Cu—Sn intermetallic compound layer is decreased as the cooling rate after the reflow treatment is higher. Since this increases the hardness of the Cu—Sn intermetallic compound layer, apparent hardness of the Sn layer increases which is more effective for reducing the friction coefficient when the material is fabricated into a terminal. The cooling rate after the reflow treatment is preferably 20° C./sec or higher and, more preferably, 35° C./sec or higher for the cooling rate from the melting point of Sn (232° C.) to a water temperature. Specifically, after the reflow treatment, the Sn plated material is instantly passed through and quenched in a water bath at a water temperature of 20 to 70° C. continuously, or the coated material after leaving the reflow heating oven is shower-cooled with water at 20 to 70° C., or cooling can be attained by the combination of the shower and the water bath. Further, after the reflow treatment, a heating reflow treatment is performed preferably in a non-oxidative atmosphere or reducing atmosphere in order to reduce the thickness of the Sn oxide film at the surface.

In the preparation method described above, each of the Ni plating layer, the Cu plating layer, and the Sn plating layer contains a Ni alloy, a Cu alloy, and a Sn alloy respectively in addition to metallic Ni, Cu and Sn. When the Ni plating layer comprises a Ni alloy and the Sn plating layer comprises a Sn alloy, each of the alloys explained previously for the Ni layer and the Sn layer can be used. Further, when the Cu plating layer comprises a Cu alloy, other constituent elements than Cu of the Cu alloy include Sn, Zn, etc. Sn is preferably less than 50 mass % and other element is preferably less than 5 mass %.

In the preparation method described above, as the base plating layer, a Co plating layer or a Fe plating layer may be formed instead of the Ni plating layer, the Ni plating layer may be formed after forming the Co plating layer or the Fe plating layer, or the Co plating layer or the Fe plating layer may be formed after forming the Ni plating layer.

A surface coating layer in which a portion of the Cu—Sn intermetallic compound layer (η-phase) is exposed at the surface may be obtained as described below.

The Sn-coated copper alloy strip according to claim 4 of the invention has a configuration in which the surface of the Sn coated layer is flat (the mean roughness Ra in the direction perpendicular to the rolling direction of the base material is 0.03 or more and 0.15 μm or less), and the η layer is exposed at the surface. The Sn-coated copper alloy strip of this form can be produced by the steps of usual cold rolling, heat treatment, plating, and the reflow treatment in the production process for the configuration described above where the η layer is not exposed by taking notice on the following points.

Polishing: After final annealing, and/or after annealing one step before the final annealing, polishing is performed by putting a rotating buff to a copper alloy strip (the rotational axis of the buff is perpendicular to the rolling direction).

Cold rolling: In the finish rolling step, rolling is performed by a roll coarser than the usual rolling roll (for example, of about #150 to 220). When the finish rolling is performed by plural passes, rolling may be performed by a coarser rolling roll in each of the passes, or rolling may be performed by a somewhat coarser rolling roll only in the final several passes or the final pass. The total roll down ratio by rolling with coarse rolling rolls is preferably 10% or more.

One or both of the polishing and the rolling described above may be performed. According to the steps, fine unevenness (polishing marks of buff and rolling marks) are formed to the copper alloy strip in the direction perpendicular to the rolling direction. In this case, the mean roughness Ra of the rolled surface of the copper alloy strip measured in the direction perpendicular to rolling is controlled, for example, within a range of 0.03 μm or more and less than 0.15 μm.

Plating: Ni plating is 0.1 μm or more and 1 μm or less and, preferably, 0.1 μm or more and 0.8 μm or less. Then, Cu plating and Sn plating are applied. The average thickness of Sn plating is twice or more of the average thickness of Cu plating, so that the Sn-coating layer of an average thickness of 0.1 to 0.7 μm remains after the reflow treatment.

By controlling the production conditions as described above, the η layer can be exposed to the surface of the Sn coated layer also in a copper alloy strip having a flat base material. Although the mechanism is not apparent, it is estimated as below. In the rolling and the polishing steps, a portion of high processing energy is formed to the surface of the copper alloy strip. It is considered that when each plating is applied to the copper alloy strip and the reflow treatment is applied in such a state, the crystal growing rate of the Cu—Sn intermetallic compound is increased at the portion where the processing energy is high and a η layer is exposed to the surface of the Sn coated layer. For giving the effect of the processing energy stored at the surface of the copper alloy strip on the crystal growing rate of the Cu—Sn intermetallic compound, it is necessary to take care, for example, that the average thickness of the Ni plating layer and the average thickness of Sn-coated layer after the reflow treatment are not excessively thick as described above.

The Sn-coated copper alloy strip according to claim 5 of the invention can be produced basically by forming a roughened surface of the copper alloy strip base material by the same method as in JP-A 2006-183068 and then applying the plating and the reflow treatment under the same conditions as those for the Sn-coated copper alloy strip according to claim 1 of the present invention. As described in JP-A 2006-183068, the roughened state of the base material of the copper alloy strip may be controlled such that the arithmetic mean roughness Ra in at least one direction is 0.15 μm or more and the arithmetic mean roughness Ra in all of the directions is 4.0 μm or less. For example, the copper alloy strip may be rolled by a rolling roll roughened by polishing or shot blasting. A random form where the η phase is distributed at random can be produced by using a roll roughened by shot blasting and a composite form comprising a random form where the η phase is distributed at random and the linear texture where the phase extends in parallel to the rolling direction can be produced by using a roughened roll prepared by polishing a rolling roll to form somewhat deep polishing marks and then forming random unevenness by shot blasting.

Example 1

Corresponding to Claims 1 to 3 where η Phase is not Exposed

Specimens Nos. 1 to 18 were obtained by applying base plating (Ni, Co, Fe), Cu plating, and Sn plating of each thickness and, subsequently, applying a reflow treatment to a copper alloy base material (C72500, Cu—9.2% Ni-2.2% Sn based alloy: 0.25 mm thickness). The Cu plating layer was eliminated in each of the specimens. Conditions for the reflow treatment were within a range of 300° C.×20 to 30 sec or 450° C.×10 to 15 sec for specimens Nos. 1 to 16 and 18 and under the existent condition (280° C.×8 sec) for the specimen No. 17. The surface of the copper alloy base material was not roughened and the surface roughness in the direction perpendicular to the rolling direction is: Ra=0.025 μm, Rmax=0.1 μm. The Cu—Sn intermetallic compound layer was not exposed at the outermost surface excepting the specimen No. 16 in which the Sn plating layer was eliminated by the reflow treatment. When the base material was measured before plating, the tensile strength was 610 MPa, elongation was 10.5% (in the direction parallel to the rolling direction, hardness was: Hv=186, and conductivity was: 12% IACS, and cracking did not occur upon W bending at R/t=1 both in the direction parallel and perpendicular to the rolling direction.

For the specimens Nos. 1 to 18, the average thickness of the Ni layer, the Co layer, the Fe layer, the Cu—Sn intermetallic compound layer, and the Sn layer, the ratio of the ϵ-phase thickness (ratio of an average thickness of the ϵ-phase to an average thickness of the Cu—Sn intermetallic compound layer), ratio of the length of ϵ-phase (ratio of the length of the ϵ-phase to the length of the Ni layer), the thickness of the $Cu_2O$ film, contact resistance and resistance to heat separation after heating for long time at high temperature were measured as described below.

(Measurement for Average Thickness of Ni Layer)

An average thickness of the Ni layer of the specimen was calculated by using a fluorescent X-ray coating thickness gauge (SFT3200, manufactured by Seiko Instruments Co.). As measuring conditions, a 2-layer calibration curve for the Sn/Ni/base material was used and the collimator diameter was set at 0.5 mmϕ.

(Measurement for Average Thickness of Co Layer)

An average thickness of the Co layer of the specimen was calculated by using a fluorescent X-ray coating thickness gauge (SFT3200, manufactured by Seiko Instruments Co.). As measuring conditions, a 2-layer calibration curve for the Sn/Co/base material was used and the collimator diameter was set at 0.5 mmϕ.

(Measurement for Average Thickness of Fe Layer)

An average thickness of the Fe layer of the specimen was calculated by using a fluorescent X-ray coating thickness gauge (SFT3200, manufactured by Seiko Instruments Co.). As measuring conditions, a 2-layer calibration curve for the Sn/Fe/base material was used and the collimator diameter was set at 0.5 mmϕ.

(Measurement for Average Thickness of Cu—Sn Intermetallic Compound Layer, Ratio of ϵ-Phase Thickness, Ratio of ϵ-Phase Length)

Cross sectional composition images (by scanning electron microscope) of a specimen fabricated by a microtome method were observed under magnification of 10,000× and the area of the Cu—Sn intermetallic compound layer was calculated by an image analysis processing, which was divided by the width of a measurement area and determined as an average thickness. Further, in identical composition images, the area of the ϵ-phase was calculated by image analysis and the value obtained by dividing the area with the width of the measurement area was defined as an average thickness of the ϵ-phase, and the ratio of the ϵ-phase thickness (ratio of the average thickness of the ϵ-phase to the average thickness of the Cu—Sn intermetallic compound layer) was calculated by dividing the average thickness of the ϵ-phase by the average thickness of the Cu—Sn intermetallic compound layer. Further, in identical composition images, the length of the ϵ-phase (length along the lateral direction of the measurement area) was measured, which was divided by the length of the Ni layer (width of the measurement area) to calculate the ratio of the ϵ-phase length (ratio of the ϵ-phase length to the length of the Ni layer). In each of the cases, measurement was performed on every five view fields and the average value was defined as the measured value.

Figure 1B:
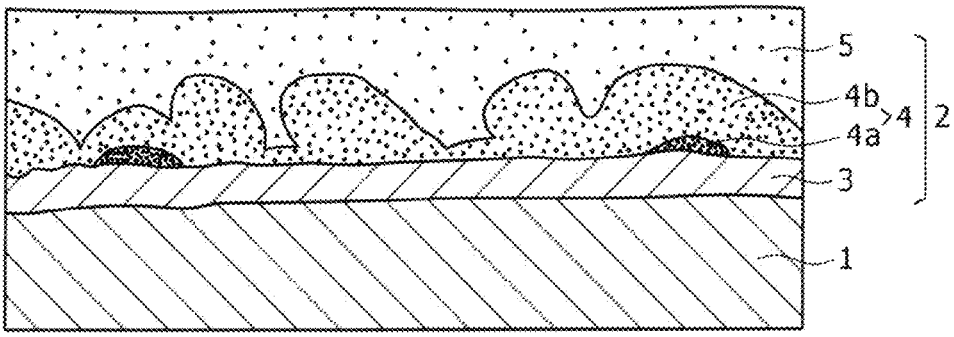
FIG. 1B is an explanatory view showing boundaries between each of layers and each of the phases of the composition images.

FIGS. 1A and 1B illustrate a photograph showing the cross sectional composition images of specimen No. 1 and an explanatory view illustrating boundaries between each of the layers and each of the phases of the composition images therebelow. As illustrated in FIG. 1B, a surface coating layer 2 is formed on the surface of a copper alloy based material 1, the surface coating layer 2 comprises a Ni layer 3, a Cu—Sn intermetallic compound layer 4, and a Sn layer 5, and the Cu—Sn intermetallic compound layer 4 comprises an ϵ-phase 4*a* and an η-phase 4*b*. The ϵ-phase 4*a* is formed between the Ni layer 3 and the η-phase 4*b*, and is in contact with the Ni layer. The ϵ-phase 4*a* and the η-phase 4*b* of the Cu—Sn intermetallic compound layer 4 were confirmed by the observation of the tone of the cross sectional composition images and quantitative analysis for the Cu content by using EDX (Energy Dispersion type X-ray Analyzer).

(Measurement of Average Thickness of Sn Layer)

The total of the film thickness of the Sn layer and the film thickness of the Sn ingredient contained in the Cu—Sn intermetallic compound layer of the specimen was measured by using a fluorescent X-ray coating thickness gauge (SFT3200, manufactured by Seiko Instruments Co.). Then, the specimen was dipped in an aqueous solution comprising p-nitrophenol and sodium hydroxide for 10 minutes to remove the Sn layer. The thickness of the Sn ingredient contained in the Cu—Sn intermetallic compound layer was measured again by using the fluorescent X-ray coating film thickness gauge. For the measuring conditions, a single layer calibration curve for the Sn/base material or a 2-layer calibration curve for the Sn/Ni/base material was used and the collimator diameter was set at 0.5 mmϕ. The average thickness of the Sn layer was calculated by subtracting the film thickness of the Sn ingredient contained in the Cu—Sn intermetallic compound layer from the sum of the thickness of the obtained Sn alloy layer and the film thickness of the Sn ingredient contained in the Cu—Sn intermetallic compound layer.

(Measurement for the Thickness of $Cu_2O$ Oxide Film)

After applying a heat treatment at 160° C. for 1,000 hours to the specimen, it was etched for 3 minutes under the condition that the etching rate to Sn was about 5 nm/min. Then, absence or presence of $Cu_2O$ was confirmed by an X-ray photoelectron spectroscope (ESCA-LAB210D, manufactured by VG Co.). The analysis conditions were such that Alkα was 300 W (15 kV, 20 mA) and analysis area was 1 mmϕ. When $Cu_2O$ was detected, it was judged that $Cu_2O$ was present at a depth of 15 nm or more from the uppermost surface of the material (thickness of the $Cu_2O$ oxide film was more than 15 nm ($Cu_2O$>15 nm)) and, when $Cu_2O$ was not detected, it was judged that $Cu_2O$ was not present at a position deeper than 15 nm from the uppermost surface of the material (the thickness of $Cu_2O$ oxide film was 15 nm or less) ($Cu_2O \leq 15$ nm)).

(Measurement of Contact Resistance after Heating for Long Time at High Temperature)

After heating the specimens at 160° C. for 1,000 hours in the air, the contact resistance was measured for five times by a 4-terminal method under the conditions at an open voltage of 20 mV, at a current of 10 mA, under the load of 3N, and with sliding movement, and the average value therefor was defined as a contact resistance value.

(Measurement of Resistance to Heat Separation after Heating for Long Time at High Temperature)

After subjecting the specimens cut out from the test material to 90° C. bending (bending radius: 0.5 mm), and heating the same at 160° C. for 1,000 hours in the air, they were bent back and absence or presence of separation in the coating layer was evaluated by appearance. If there was no separation it was evaluated as good and if separation was present it was evaluated as poor.

TABLE 1

| No. | Surface coating layer thickness (μm) Base | Cu—Sn | Sn | ϵ-phase thickness ratio (%) | ϵ-phase length ratio (%) | $Cu_2O$ thickness (nm) | Contact resistance after heating at high temperature (mΩ) | Resistance to heat separation |
|---|---|---|---|---|---|---|---|---|
| 1 | Ni: 0.3 | 0.5 | 1.0 | 3 | 17 | <15 | 0.6 | good |
| 2 | Ni: 0.6 | 0.6 | 0.2 | 0 | 0 | <15 | 0.7 | good |
| 3 | Ni: 0.8 | 0.7 | 0.5 | 7 | 30 | <15 | 0.7 | good |
| 4 | Ni: 0.4 | 0.5 | 2.3 | 12 | 42 | <15 | 0.4 | good |
| 5 | Ni: 0.3 | 2.0 | 0.3 | 18 | 48 | <15 | 0.9 | good |
| 6 | Ni: 1.5 | 0.3 | 0.4 | 26 | 45 | <15 | 1.0 | good |
| 7 | Ni: 2.2 | 0.8 | 1.0 | 13 | 30 | <15 | 0.5 | good |
| 8 | Co: 0.4 | 0.4 | 0.8 | 18 | 43 | <15 | 1.0 | good |
| 9 | Fe: 0.4 | 0.5 | 1.2 | 16 | 36 | <15 | 0.8 | good |
| 10 | Ni: 0.3<br>Co: 0.4 | 0.5 | 0.4 | 8 | 25 | <15 | 0.5 | good |
| 11 | Ni: 0.3<br>Fe: 0.4 | 0.4 | 0.5 | 9 | 30 | <15 | 0.4 | good |
| 12 | Ni: 0.5 | 0.4 | 0.2 | 18 | 40 | <15 | 0.7 | good |
| 13 | Ni: 0.5 | 0.5 | 0.3 | 28 | 53 | <15 | 0.8 | poor |
| 14 | Ni: 0.05 | 0.5 | 0.4 | 20 | 40 | <15 | 5 | good |
| 15 | Ni: 0.4 | 0.05 | 1.0 | 5 | 15 | ≥15 | 12 | poor |
| 16 | Ni: 0.5 | 0.5 | 0 | 10 | 30 | ≥15 | 6 | good |
| 17 | Ni: 0.5 | 0.4 | 0.2 | 50 | 90 | ≥15 | 7 | poor |
| 18 | — | 0.4 | 0.8 | 10 | 25 | ≥15 | 10 | poor |
| 19 | Ni: 0.8 | 0.8 | 0.5 | 26 | 44 | <15 | 1.0 | good |
| 20 | Ni: 0.8 | 0.8 | 0.5 | 34 | 48 | ≥15 | 1.3 | good |
| 21 | Ni: 0.8 | 0.8 | 0.5 | 28 | 58 | <15 | 0.8 | poor |
| 22 | Ni: 0.8 | 0.9 | 0.5 | 37 | 65 | ≥15 | 3.8 | poor |

No. 19: Example in which the ϵ phase thickness ratio <30%, and the ϵ phase length ratio <50% (within the range of claims but lager than those of No. 3 and near the upper limit), $Cu_2O$ thickness <15 nm, and the contact resistance is 1 mΩ which is somewhat larger than that of No. 3.

No. 20: Example in which the ϵ phase thickness ratio >30%, and the ϵ phase length ratio <50%, $Cu_2O$ thickness ≥15 nm, and the contact resistance is somewhat larger than that of No. 3 and more than 1 mΩ (1.3 mΩ).

No. 21: Example in which the ϵ phase thickness ratio <30%, and the ϵ phase length ratio >50%, $Cu_2O$ thickness ≥15 nm, and the contact resistance is somewhat larger than that of No. 3, and separation of the coating layer occurs.

No. 22: Example in which the ϵ phase thickness ratio >30%, the ϵ phase length ratio >50%, $Cu_2O$ thickness ≥15 nm, and the contact resistance is about 4 mΩ which is somewhat larger than that of No. 3 (3.8 mΩ).

The results are shown in Table 1.

In the specimens Nos. 1 to 13, and 19 that satisfy the definition of the invention for the configuration of the surface coating layer and average thickness of each of the layers, as well as the ϵ-phase thickness ratio, the thickness of the $Cu_2O$ oxide film is 15 nm or less and the contact resistance after heating for long time at high temperature is maintained to a low value of 1.0 mΩ or less. Further, in the specimens Nos. 1 to 12, and 19 that satisfy the definition of the invention for the ϵ-phase length ratio, the resistance to heat separation is also excellent.

On the other hand, in the specimen No. 14 in which the average thickness of the Ni layer is thin, the specimen No. 15 in which the average thickness of the Cu—Sn intermetallic compound layer is thin, the specimen No. 16 in which the Sn layer is eliminated, the specimen No. 17 in which the reflow treatment is applied under the existent conditions and the ϵ-phase ratio is high, and the specimen No. 18 in which the Ni layer is not present, the contact resistance is increased after heating for long time at high temperature. In the specimens Nos. 15 to 18, the thickness of the $Cu_2O$ oxide film is more than 15 nm.

In Nos. 20 to 22, the configuration of the surface plating layer and the average thickness for each of the layers satisfy the definition of the invention. However, in No. 20, while the separation does not occur since the ϵ phase length ratio satisfies the definition of the invention, the ϵ phase thickness ratio does not satisfy the definition of the invention, the thickness of the $Cu_2O$ oxide film exceeds 15 nm, and the contact resistance after heating for long time at high temperature exceeds 1.0 mΩ. In specimen No. 21, while the contact resistance after heating for long time at high temperature is less than 1.0 mΩ since the ϵ phase thickness ratio satisfies the definition of the invention, the ϵ phase length ratio does not satisfy the definition of the invention and separation occurs. In specimen No. 22, both the ϵ phase thickness ratio and the ϵ phase length ratio do not satisfy the definition of the invention, the thickness of the $Cu_2O$ oxide film exceeds 15 nm, the contact resistance after heating for long time at high temperature is as high as 3.8 mΩ, and separation occurs. When the boundary between the Ni layer and the Cu—Sn intermetallic compound layer in each of the specimens was observed, it was confirmed that voids were not formed at the boundary in the specimens not generating separation, whereas many voids were formed in the specimens generating the separation and such voids were joined to generate the separation.

Example 2

Specimens Nos. 19 to 25 were obtained by applying a surface roughening treatment to a copper alloy base material (identical with that of Example 1: 0.25 mm thickness) by a mechanical method (rolling by a rolling roll roughened by shot blasting or roughened by polishing and shot blasting) in various roughness and forms (except for the specimen No. 24), applying Ni plating, Cu plating, and Sn plating by each thickness, and applying a reflow treatment. The conditions for the reflow treatment were within a range of 300° C.×25 to 35 sec or 450° C.×10 to 15 sec for the specimens Nos. 19 to 24 and Nos. 26 to 29, and under the existent condition (280° C.×8 sec) for the specimen No. 25.

For the specimens Nos. 19 to 29, the average thickness of the Ni layer, the Cu—Sn intermetallic compound layer, and the Sn layer, the ϵ-phase thickness ratio, the ϵ phase length ratio, the contact resistance after heating for long time at high temperature and resistance to heat separation after heating for long time at high temperature were measured by the same procedures as in Example 1. Further, the surface roughness of the Sn-coated layer, the ratio of the surface exposure area, and the friction coefficient of the Cu—Sn intermetallic compound layer were measured by the following procedures.

(Surface Roughness of Sn-Coated Layer)

The surface roughness was measured according to JIS B0601-1994 by using a contact type surface roughness gauge (SURFCOM 1400 manufactured by Tokyo Seimitsu Co., Ltd.). The measuring conditions for the surface roughness were 0.8 mm of cut off value, 0.8 mm of reference length, 4.0 mm for evaluation length, 0.3 mm/s of measuring rate, and 5 μmR of radius of probe top end. The surface roughness was measured in the direction perpendicular to the rolling or polishing direction performed upon surface roughening treatment (direction in which the surface roughness is largest).

(Measurement for the Ratio of Surface Exposure Area of Cu—Sn Intermetallic Compound Layer)

The surface of the specimen was observed under magnification of 200× by SEM (Scanning Electron Microscope) having EDX (Energy Dispersion type X spectroscopy) mounted thereon, and the ratio of surface exposure area of the Cu—Sn intermetallic compound layer was measured by image analysis based on light and shade (except for contrast caused by stains or scuff) of the obtained composition images. At the same time, an exposure form of the Cu—Sn intermetallic compound layer was observed. The exposure form comprised linear texture and/or random texture and all of the linear textures were formed in parallel to the rolling direction.

(Measurement of Friction Coefficient)

Figure 2:
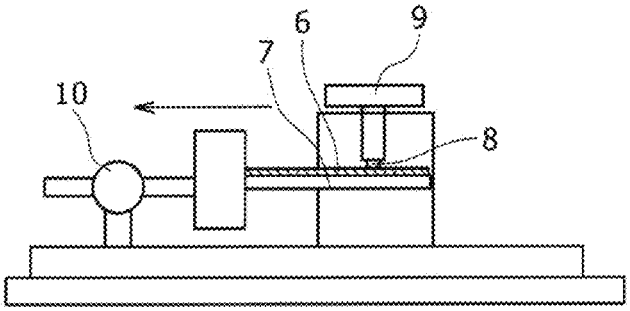
FIG. 2 is a conceptional view of a jig for measuring friction coefficient.

The shape of an indent portion of an electric contact in a mating connector part was simulated and measured by using equipment as illustrated in FIG. 2. At first, a male test plate 6 cut out from each of the specimens Nos. 19 to 25 was fixed on a horizontal substrate 7, on which a female specimen 8 of a semispherical work (inner diameter 1.5 mmϕ) cut out from the specimen No. 18 (Example 1) was placed and their surfaces were in contact to each other. Successively, the male specimen 6 was held by applying a load of 3.0 N (weight 9) on the female specimen 8, the male specimen 6 was pulled in a horizontal direction by using a horizontal load tester (model-2152, manufactured by AICOH ENGINEERING Co. Ltd.) (sliding speed at 80 mm/min), and a maximum friction force F (unit: N) was measured up to a 5 mm sliding distance. The friction coefficient was determined by the following formula (1). In the drawing, 10 represents a load cell and an arrow represents a sliding direction, and the sliding direction is perpendicular to the rolling direction.

$$\text{Friction coefficient}=F/3.0 \quad (1)$$

TABLE 2

| No. | Surface coating layer thickness (μm) Ni | Cu—Sn | Sn | Surface coating layer mean roughness (μm) | ϵ-phase thickness ratio (%) | ϵ-phase length ratio (%) | $Cu_2O$ thickness (nm) | Cu—Sn intermetallic compound layer exposure form | Cu—Sn intermetallic compound layer exposure ratio (%) | Contact resistance after heating at high temperature (mΩ) | Resistance to heat separation | Friction coefficient |
|---|---|---|---|---|---|---|---|---|---|---|---|---|
| 19 | 0.25 | 0.5 | 0.25 | 1.10 | 5 | 12 | <15 | Linear + random | 61 | 1.0 | good | 0.22 |
| 20 | 0.4 | 0.5 | 0.5 | 0.52 | 16 | 30 | <15 | Random | 50 | 0.9 | good | 0.27 |
| 21 | 0.4 | 0.6 | 0.3 | 0.95 | 13 | | <15 | Linear + random | 60 | 0.9 | good | 0.23 |
| 22 | 0.5 | 0.9 | 1.1 | 0.72 | 0 | 0 | <15 | Linear + random | 37 | 0.7 | good | 0.41 |
| 23 | 0.4 | 0.3 | 0.6 | 0.40 | 15 | 30 | <15 | Random | 2 | 0.8 | good | 0.50 |
| 24 | 0.4 | 0.5 | 1.0 | 0.08* | 20 | 38 | <15 | Not exposed | 0 | 0.7 | good | 0.55 |
| 25x | 0.4 | 0.6 | 0.3 | 0.92 | 50 | 73 | ≥15 | Random | 60 | 5 | poor | 0.24 |
| 26 | 0.4 | 0.5 | 0.4 | 0.65 | 0 | 0 | <15 | Random | 60 | 0.9 | good | 0.25 |
| 27 | 0.4 | 0.5 | 0.4 | 0.13* | 0 | 0 | <15 | Random | 20 | 0.8 | good | 0.40 |
| 28 | 0.4 | 0.5 | 0.4 | 0.58 | 25 | 52* | <15 | Random | 57 | 1.0 | poor | 0.26 |
| 29 | 0.4 | 0.5 | 0.4 | 0.63 | 33* | 47 | ≥15 | Random | 55 | 1.5 | good | 0.27 |

The results are shown in Table 2.

In the specimens Nos. 19 to 23, 26 and 28 that satisfy the definition of the invention for the configuration of the surface coating layer, the average thickness for each of the layers, mean roughness of the surface coating layer, as well as the ϵ-phase thickness ratio, the contact resistance after heating for long time at high temperature was kept at a low value of 1.0 mΩ or less. Among them, in the specimens Nos. 19 to 22, 26 and 28 that satisfy the definition of the invention for the ratio of the surface exposure of the Cu—Sn intermetallic compound layer, the friction coefficient is lower than that of the specimen No. 24 in which the surface exposure ratio is zero. In the specimen No. 23 in which the surface exposure ratio is somewhat low, the friction coefficient is lower than that of the specimen Nos. 24 in which the surface exposure ratio is zero but shows higher friction coefficient than that of the specimens Nos. 19 to 22.

On the other hand, in the specimen No. 25 not satisfying the definition of the invention for the s-phase thickness ratio, the contact resistance after heating for long time at high temperature is increased. Since the specimen No. 25 satisfies the definition of the invention for the ratio of surface exposure of the Cu—Sn intermetallic compound layer, the friction coefficient is low. In the specimen No. 27 in which only the mean roughness of the surface coated layer does not satisfy the range of the present invention, the exposure ratio of the Cu—Sn intermetallic compound layer is lower and the friction coefficient is higher compared with the specimen No. 26 in which the thickness of each of the coating layers is identical. In the specimen No. 29 in which the thickness ratio of the surface coating layer does not satisfy the definition of the invention, contact resistance after heating for long time at high temperature exceeds 1.0 mΩ.

Example Corresponding to Claim 4 (Base Material is Flat)

Specimens Nos. 31 to 39 were obtained by forming rolling marks or/and polishing marks parallel to the rolling direction of the base material to a copper alloy base material (Cu-2.2% Fe-0.03% P-0.15% Zn alloy, 0.25 mm thickness), applying Ni plating, Cu plating, and Sn plating to each thickness, and then applying reflow treatment by the method described in column 21. Conditions for reflow treatment were in a range of 300° C.×25 to 35 sec or 450° C.×10 to 15 sec for the specimens Nos. 31 to 35 and Nos. 37 to 39, and conventional conditions (280° C.×8 sec) for the specimen No. 36.

When the base material was measured before plating, a tensile strength was 530 MPa, an elongation of 12% (in the direction parallel to the rolling direction), hardness was: Hv=156, a conductivity was 66% IACS, and cracking did not occur upon W bending at R/t=1 both in the direction parallel and perpendicular to the rolling direction.

For the specimens Nos. 31 to 39, average thickness of the Ni layer, the Cu—Sn intermetallic compound layer, and the Sn layer, ϵ phase thickness ratio, ϵ phase length ratio, contact resistance after heating for long time at high temperature, resistance to heat separation after heating for long time at high temperature, surface roughness of the Sn-coated layer, the ratio of surface exposure area and the friction coefficient (direction perpendicular to the rolling direction: ⊥ direction parallel to the rolling direction: //) of the Cu—Sn intermetallic compound layer were measured by the same procedures as in Example 1 and Example 2. Further, they were measured by the following procedures.

TABLE 3

| No. | Surface coating layer thickness (μm) Ni | Cu—Sn | Sn | Surface coating layer mean roughness (μm) | ϵ-phase thickness ratio (%) | ϵ phase length ratio (%) | $Cu_2O$ thickness (nm) | Cu—Sn intermetallic compound layer exposure form |
|---|---|---|---|---|---|---|---|---|
| 31 | 0.4 | 0.5 | 0.25 | 0.05 | 0 | 0 | <15 | Linear |
| 32 | 0.4 | 0.5 | 0.25 | 0.08 | 10 | 20 | <15 | Linear |
| 33 | 0.3 | 0.6 | 0.15 | 0.11 | 5 | 13 | <15 | Linear |
| 34 | 0.5 | 0.5 | 0.4 | 0.04 | 10 | 23 | <15 | Linear |
| 35 | 0.4 | 0.5 | 0.25 | 0.07 | 26 | 45 | <15 | Linear |
| 36 | 0.4 | 0.5 | 0.20 | 0.13 | 35* | 58* | ≥15 | Linear |
| 37 | 0.4 | 0.4 | 0.25 | 0.08 | 24 | 51* | <15 | Linear |
| 38 | 0.25 | 0.38 | 0.9 | 0.06 | 15 | 26 | <15 | Linear |
| 39 | 0.4 | 0.5 | 0.4 | 0.22* | 0 | 0 | <15 | Linear |
| 40 | 0.4 | 0.5 | 0.25 | 0.04 | 0 | 0 | <15 | Linear |

| No. | Cu—Sn intermetallic compound layer exposure ratio (%) | Contact resistance after heating at high temperature (mΩ) | Resistance to heat separation | Friction coefficient ⊥ | Friction coefficient // |
|---|---|---|---|---|---|
| 31 | 38 | 0.9 | good | 0.38 | 0.44 |
| 32 | 40 | 1.0 | good | 0.36 | 0.48 |
| 33 | 43 | 1.0 | good | 0.34 | 0.39 |
| 34 | 28 | 0.7 | good | 0.40 | 0.48 |
| 35 | 46 | 1.0 | good | 0.36 | 0.42 |
| 36 | 45 | 4.6 | poor | 0.38 | 0.42 |
| 37 | 32 | 0.9 | poor | 0.37 | 0.45 |
| 38 | 26 | 0.7 | good | 0.48 | 0.52 |
| 39 | 20 | 1.8* | poor | 0.40 | 0.46 |
| 40 | Not exposed | 0.9 | good | 0.57 | 0.59 |

The results are shown in Table 3.

In the specimens Nos. 31 to 35, 37, 38, and 40 that satisfy the definition of the invention for the configuration of the surface plating layer, the average thickness for each of the layers, mean roughness of the surface coated layer, and the ϵ-phase thickness ratio, the contact resistance after heating for long time at high temperature was kept at a low value of 1.0 mΩ or less. Among them, in the specimens Nos. 31 to 35, 37, and 38 that satisfy the definition of the invention for the ratio of the surface exposure of the Cu—Sn intermetallic compound layer, the friction coefficient is lower than that of the specimen No. 40 in which the surface exposure ratio is zero. In the specimens, since the η layer is exposed parallel to the rolling direction, the friction coefficient in the direction perpendicular to the rolling direction is lower than that in the direction parallel to the rolling direction in each of them and the specimens are optimal as the material for a mating terminal in which the insertion direction of the terminal is in the direction perpendicular to the rolling direction.

On the other hand, in the specimen No. 36 in which the thickness ratio and the length ratio of the ϵ phase do not satisfy the definition of the invention, contact resistance after heating for long time at high temperature is increased and the coating layer was separated after heating for long time at high temperature. In the specimen No. 37 in which only the ϵ phase length ratio does not satisfy the definition of the invention, the coating layer was separated after heating for long time at high temperature. Other properties are satisfactory. In the specimen No. 39 in which the mean roughness of the surface coating layer exceeds the upper limit of the invention, the thickness ratio and the length ratio of the ϵ phase are within the range of the invention but the contact resistance after heating at high temperature exceeds 1.0 mΩ and separation of the coating layer was observed. When the cross section of the specimens Nos. 36, 37, and 39 where the coating layer was separated were observed, voids at the boundary between the Ni layer and the Cu—Sn intermetallic compound layer (ϵ phase) caused separation in the specimens Nos. 36 and 37 and voids were observed at the interface between the base material and the Ni layer in the specimen No. 39. It is considered that since the base material was polished intensely in the specimen No. 39, an affected layer was formed at the surface to lower the adhesion strength between Ni plating and the base material, and voids were formed after heating at high temperature. It is supposed that increase in the contact resistance compared with other specimens was also due to voids formed at the boundary between the Ni plating and the base material.

What is claimed is:

1. A Sn-coated copper alloy strip, comprising:

a surface coating layer comprising a Ni layer, a Cu—Sn intermetallic compound layer, and a Sn layer formed in this order, and a base material comprising a copper alloy strip, wherein the surface coating layer covers over a surface of the base material, an average thickness of the Ni layer is 0.6 to 3.0 μm, an average thickness of the Cu—Sn intermetallic compound layer is 0.2 to 3.0 μm, an average thickness of the Sn layer is 0.01 to 5.0 μm, the Cu—Sn intermetallic compound layer comprises an η-phase and does not comprise an ϵ-phase, a portion of the η phase is exposed to a surface of the surface coating layer with a ratio of surface exposure area of from 3 to 75%, and the surface coating layer has a surface roughness such that an arithmetic mean roughness Ra in at least one direction is 0.15 μm or more and an arithmetic mean roughness Ra in all directions is 3.0 μm or less.

2. The Sn-coated copper alloy strip according to claim 1, wherein a Co layer or a Fe layer is formed instead of the Ni layer, and an average thickness of the Co layer or the Fe layer is 0.1 to 3.0 μm.

3. The Sn-coated copper alloy strip according to claim 1, wherein a Co layer or a Fe layer is formed between the surface of the base material and the Ni layer or between the Ni layer and the Cu—Sn intermetallic compound layer, and an average thickness of the Ni layer and the Co layer in total or the Ni layer and the Fe layer in total is 0.7 to 3.0 μm.

4. The Sn-coated copper alloy strip according to claim 1, wherein $Cu_2O$ is not present at a depth of 15 nm or more from an uppermost surface of the Sn-coated copper alloy strip after heating at 160° C. for 1,000 hours in the air.

5. A Sn-coated copper alloy strip, comprising:

a surface coating layer comprising a Ni layer, a Cu—Sn intermetallic compound layer, and a Sn layer formed in this order, and a base material comprising a copper alloy strip, wherein the surface coating layer covers over a surface of the base material, an average thickness of the Ni layer is 0.6 to 3.0 μm, an average thickness of the Cu—Sn intermetallic compound layer is 0.2 to 3.0 μm, an average thickness of the Sn layer is 0.01 to 5.0 μm, the Cu—Sn intermetallic compound layer comprises an ϵ-phase and an η-phase, the ϵ-phase is present between the Ni layer and the η-phase, a ratio of a length of the ϵ-phase to a length of the Ni layer in a cross section of the surface coating layer is 50% or less, and a ratio of an average thickness of the ϵ-phase to an average thickness of the Cu—Sn intermetallic compound layer is 30% or less.

6. The Sn-coated copper alloy strip according to claim 5, wherein a portion of the η-phase is exposed to a surface of the surface coating layer with a ratio of surface exposure area of from 3 to 75%, and the surface coating layer has a mean roughness Ra in a direction perpendicular to a rolling direction of the base material of 0.03 μm or more and less than 0.15 μm.

7. The Sn-coated copper alloy strip according to claim 6, wherein a Co layer or a Fe layer is formed instead of the Ni layer, and an average thickness of the Co layer or the Fe layer is 0.1 to 3.0 μm.

8. The Sn-coated copper alloy strip according to claim 6, wherein a Co layer or a Fe layer is formed between the surface of the base material and the Ni layer or between the Ni layer and the Cu—Sn intermetallic compound layer, and an average thickness of the Ni layer and the Co layer in total or the Ni layer and the Fe layer in total is 0.7 to 3.0 μm.

9. The Sn-coated copper alloy strip according to claim 6, wherein $Cu_2O$ is not present at a depth of 15 nm or more from an uppermost surface of the Sn-coated copper alloy strip after heating at 160° C. for 1,000 hours in the air.

10. The Sn-coated copper alloy strip according to claim 5, wherein a portion of the η phase is exposed to a surface of the surface coating layer with a ratio of surface exposure area of from 3 to 75%, and the surface coating layer has a surface roughness such that an arithmetic mean roughness Ra in at least one direction is 0.15 μm or more and an arithmetic mean roughness Ra in all directions is 3.0 μm or less.

11. The Sn-coated copper alloy strip according to claim 10, wherein a Co layer or a Fe layer is formed instead of the Ni layer, and an average thickness of the Co layer or the Fe layer is 0.1 to 3.0 μm.

12. The Sn-coated copper alloy strip according to claim 10, wherein a Co layer or a Fe layer is formed between the surface of the base material and the Ni layer or between the Ni layer and the Cu—Sn intermetallic compound layer, and an average thickness of the Ni layer and the Co layer in total or the Ni layer and the Fe layer in total is 0.7 to 3.0 μm.

13. The Sn-coated copper alloy strip according to claim 10, wherein $Cu_2O$ is not present at a depth of 15 nm or more from an uppermost surface of the Sn-coated copper alloy strip after heating at 160° C. for 1,000 hours in the air.

* * * * *